US009003731B2

(12) United States Patent
Gosling et al.

(10) Patent No.: US 9,003,731 B2
(45) Date of Patent: Apr. 14, 2015

(54) MODULAR WALL NESTING SYSTEM

(75) Inventors: Geoff Gosling, Calgary (CA); Mogens Smed, DeWinton (CA)

(73) Assignee: DIRTT Enviornmental Solutions, Ltd., Calgary (CA)

( * ) Notice: Subject to any disclaimer, the term of this patent is extended or adjusted under 35 U.S.C. 154(b) by 0 days.

(21) Appl. No.: 13/579,257

(22) PCT Filed: Jun. 11, 2012

(86) PCT No.: PCT/US2012/041906
§ 371 (c)(1),
(2), (4) Date: Aug. 15, 2012

(87) PCT Pub. No.: WO2012/173930
PCT Pub. Date: Dec. 20, 2012

(65) Prior Publication Data
US 2014/0102021 A1 Apr. 17, 2014

Related U.S. Application Data

(60) Provisional application No. 61/495,974, filed on Jun. 11, 2011.

(51) Int. Cl.
*E04B 2/74* (2006.01)
*E04B 2/72* (2006.01)
*E04C 2/38* (2006.01)

(52) U.S. Cl.
CPC ..... *E04B 2/7453* (2013.01); *E04B 2/745* (2013.01); *E04B 2002/7483* (2013.01); *E04B 2/721* (2013.01); *E04C 2/38* (2013.01)

(58) Field of Classification Search
CPC ..... E04B 2/7425; E04B 2/7433; E04B 2002/7462; E04B 2002/7487
USPC ..... 52/239, 220.7, 36.1, 481.2; 160/135
See application file for complete search history.

(56) References Cited

U.S. PATENT DOCUMENTS 5,351,452 A * 10/1994 Gates ..... 52/254
5,592,794 A * 1/1997 Tundaun ..... 52/220.7
5,600,926 A 2/1997 Ehrlich
5,642,593 A 7/1997 Shieh
5,813,178 A 9/1998 Edwards
5,839,240 A 11/1998 Eisholz (Continued)

FOREIGN PATENT DOCUMENTS

CH 686795 6/1996
DE 202004017808 1/2005

(Continued)

OTHER PUBLICATIONS

International Search Report and Written Opinion for PCT/US2012/041906 mailed Jan. 31, 2013.

(Continued)

*Primary Examiner* — Andrew J Triggs
(74) *Attorney, Agent, or Firm* — Workman Nydegger

(57) ABSTRACT

Implementations of the present invention relate to systems, methods, and apparatus for incorporating face- and center-mounted panels into a single wall module to form nested wall modules. For instance, face-mounted panels can nest within the center-mounted panels. Additionally or alternatively, center-mounted panels can nest within the face-mounted panels to form windows.

24 Claims, 10 Drawing Sheets

(56) References Cited

U.S. PATENT DOCUMENTS

| | | | | |
|---|---|---|---|---|
| 5,913,787 | A | 6/1999 | Edwards | |
| 5,950,386 | A | 9/1999 | Shipman | |
| 6,141,926 | A * | 11/2000 | Rossiter et al. | 52/239 |
| 6,158,179 | A | 12/2000 | Ackerly | |
| 6,250,032 | B1 | 6/2001 | Davis | |
| 6,260,321 | B1 | 7/2001 | Rudduck | |
| 6,282,854 | B1 | 9/2001 | Vos | |
| 6,341,457 | B1 * | 1/2002 | Aerts et al. | 52/239 |
| 6,363,663 | B1 | 4/2002 | Kane | |
| 6,481,168 | B1 | 11/2002 | Hodges | |
| 6,530,181 | B1 * | 3/2003 | Seiber et al. | 52/126.3 |
| 6,920,727 | B2 | 7/2005 | Yu | |
| 7,051,482 | B2 | 5/2006 | MacDonald | |
| 7,310,918 | B1 | 12/2007 | Reuter | |
| 7,451,577 | B2 | 11/2008 | Little | |
| 7,461,484 | B2 * | 12/2008 | Battey et al. | 52/220.7 |
| 7,661,237 | B2 | 2/2010 | Jakob-Bamberg | |
| 7,908,805 | B2 | 3/2011 | Metcalf | |
| 7,984,598 | B2 * | 7/2011 | Gosling et al. | 52/582.2 |
| 8,534,021 | B2 | 9/2013 | Liu | |
| 8,683,745 | B2 * | 4/2014 | Artwohl et al. | 49/70 |
| 2002/0108330 | A1 | 8/2002 | Yu | |
| 2002/0157335 | A1 | 10/2002 | Vos | |
| 2003/0089057 | A1 | 5/2003 | Wiechecki | |
| 2003/0221384 | A1 | 12/2003 | Burken | |
| 2004/0020137 | A1 | 2/2004 | Battey | |
| 2004/0035074 | A1 | 2/2004 | Stanescu | |
| 2004/0177573 | A1 | 9/2004 | Newhouse | |
| 2006/0059806 | A1 | 3/2006 | Gosling | |
| 2006/0185276 | A1 | 8/2006 | Pai | |
| 2008/0302054 | A1 | 12/2008 | Gosling | |
| 2009/0293406 | A1 * | 12/2009 | Gosling et al. | 52/582.1 |
| 2010/0192511 | A1 * | 8/2010 | Gosling et al. | 52/745.13 |
| 2014/0102021 | A1 * | 4/2014 | Gosling et al. | 52/234 |

FOREIGN PATENT DOCUMENTS

| | | |
|---|---|---|
| GB | 2221946 | 2/1990 |
| JP | 2003105908 | 4/2003 |
| JP | 2005155223 | 6/2005 |
| KR | 1020000049102 | 7/2000 |
| KR | 1020070077502 | 7/2007 |

OTHER PUBLICATIONS

European Search Report, EP 12800672, Mailed Oct. 10, 2014.

* cited by examiner

MODULAR WALL NESTING SYSTEM

CROSS-REFERENCE TO RELATED APPLICATIONS

This application is a 35 U.S.C. §371 National Stage of PCT/US12/41906, filed on Jun. 11, 2012, entitled "Modular Wall Nesting System," which claims priority to U.S. Provisional Patent Application No. 61/495,974, filed on Jun. 11, 2011. The entire content of each of the afore-mentioned patent applications is incorporated by reference herein.

BACKGROUND OF THE INVENTION

1. The Field of the Invention invention generally relates to modular wall systems. More specifically, the present invention relates to apparatus, systems, and methods for nesting windows, other panels, passthroughs, or other objects into module wall panels.

2. Background and Relevant Art

Office space can be relatively expensive be due to the basic costs of the location and size of the office space. In addition to these costs, an organization may incur further expense configuring the office space in a desirable layout. An organization might purchase or rent a large open space in a building, and then subdivide or partition the open space into various offices, conference rooms, or cubicles. Rather than having to find new office space and move as an organization's needs change, it is often desirable to reconfigure the existing office space. Many organizations address their configuration and reconfiguration issues by dividing large, open office spaces into individual work areas using modular wall segments (or wall modules) and partitions.

In particular, at least one advantage of modular wall systems is that they are relatively easy to configure. In addition, modular wall systems can be less expensive to set up and can allow for reconfiguration more easily than more permanently constructed office dividers. For example, an organization can construct a set of offices and a conference area within a larger space in a relatively short period of time with the use of modular wall systems. If office space needs change, the organization can readily reconfigure the space.

In general, modular office partitions typically include a series of individual wall modules (and/or panels). The individual wall modules are typically free-standing or rigidly attached to one or more support structures. In particular, a manufacturer or assembler can usually align and join the various wall modules together to form an office, a room, a hallway, or otherwise divide an open space.

While conventional modular wall systems can provide various advantages, such as those described above, conventional modular wall systems are limited in design choices. For example, many conventional modular wall systems do not allow for inclusion of windows or other objects within a panel. Other conventional modular wall systems may allow for windows or other objects within a panel, typically do not provide much functional or aesthetic variability without complicated or time consuming installation procedures.

Accordingly, there are a number of disadvantages with conventional solid wall systems that can be addressed.

BRIEF SUMMARY OF THE INVENTION

Implementations of the present invention solve one or more of the foregoing or other problems in the art with systems, methods, and apparatus for nesting windows, other panels, passthroughs, or other objects into module wall panels to form nested wall modules. For instance, the nested wall modules can include one or more center-mounted panels nested within face-mounted panels. In such systems, the center-mounted panel can form a window within the face-mounted panels. In additional implementations, the nested wall modules can include face-mounted panels nested within a center-mounted panel. Still further implementations, can include passthroughs, openings, shadow boxes, or other objects nested within a modular wall panel. Furthermore, these systems and components enable quick and efficient assembly, disassembly, and reconfiguration of nested wall modules with great ease. Accordingly, implementations of the present invention can be easily adapted to the environment of use and provide a number of secure mounting options.

For example, an implementation of a nested wall module includes at least two upright supports configured to couple the nested wall module to another wall module. The nested wall module further includes a center-mounted panel and a pair of face-mounted panels secured between the at least two upright supports. Additionally, the center-mounted panel is nested within the pair of face-mounted panels. Alternatively, the pair of face-mounted panels are nested within the center-mounted panel.

Additionally, one implementation of a modular wall system includes a plurality of wall modules coupled together to form a divider or wall. One or more wall modules of the plurality of wall modules comprise a nested wall module. The nested wall module includes a pair of face-mounted panels coupled to a support frame, a hole extending through the pair of face-mounted panels, and a center-mounted panel secured within the hole of the pair of face-mounted panels. Alternatively, the nested wall modules include a center-mounted panel coupled to a support frame, and a hole extending through the center-mounted panel, and a pair of face-mounted panels secured within the hole of the center-mounted panel. Still further, the nested wall modules includes a pair of face-mounted panels coupled to a support frame, and a passthrough nested within the pair of face-mounted panels In addition to the foregoing, a nesting frame assembly for coupling one or more face-mounted panel and center-mounted panels within a nested wall module comprises a plurality of nesting brackets. The nesting frame assembly also includes one or more corner cinch assemblies sized and configured to couple two or more nesting brackets of the plurality of nesting brackets together. Each bracket of the plurality of nesting brackets comprises a panel channel sized and configured to hold an edge of a center-mounted panel therein; one or more cinch channels sized and configured to a corner cinch assemblies; and one or more engagement protrusions configured to couple one or more connectors.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. For better understanding, the like elements have been designated by like reference numbers throughout the various accompanying Figures. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
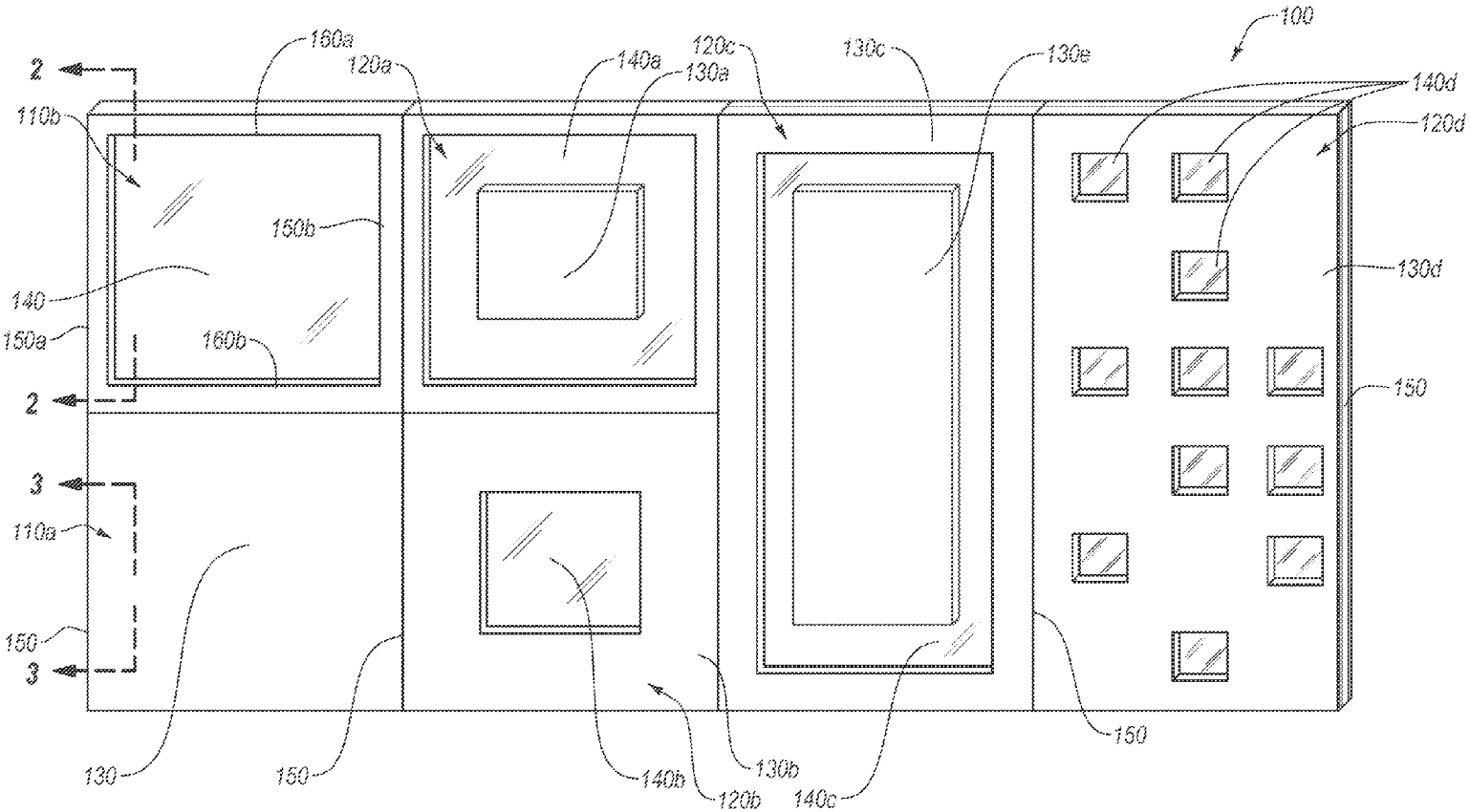
FIG. 1 illustrates a perspective view of a modular wall system incorporating nested wall modules in accordance with one or more implementations of the present invention.

Implementations of the present invention provide systems, methods, and apparatus for nesting windows, other panels, passthroughs, or other objects into module wall panels to form nested wall modules. For instance, the nested wall modules can include one or more center-mounted panels nested within face-mounted panels. In such systems, the center-mounted panel can form a window within the face-mounted panels. In additional implementations, the nested wall modules can include face-mounted panels nested within a center-mounted panel. Still further implementations, can include passthroughs, openings, shadow boxes, or other objects nested within a modular wall panel. Furthermore, these systems and components enable quick and efficient assembly, disassembly, and reconfiguration of nested wall modules with great ease. Accordingly, implementations of the present invention can be easily adapted to the environment of use and provide a number of secure mounting options.

In one or more implementations, the nested wall module also can have a plurality of face-mounted and center-mounted panels nested one within the other in an alternating fashion. In particular, the nested wall module can have a pair of face-mounted panels that has center-mounted panel nested therein, and the center-mounted panel in turn can have a second pair of face-mounted panels nested therein. Furthermore, the nested wall module can incorporate multiple and alternating face-mounted and center-mounted panels nested one within the other.

In particular, in one or more implementations, a panel of a modular wall system includes one or more openings for encasing an inner tile, such as glass or another transparent or translucent material, to form one or more windows in the panel. The openings in the panel can include window extrusions (i.e., nesting brackets) for securing the glass or other material within the panel. Panels according to one or more implementations are modular and enable an existing solid wall system to be modified to include panels with windows.

In still further implementations, the nested wall module can nest a shadow box, an inset or outset aesthetic detail, a passthrough (i.e., a hole through the modular wall), or a functional component (e.g., a shelf, a desktop). Indeed, one will appreciate in light of the disclosure herein that the hardware, systems, and methods can allow an installer to seamlessly nest a wide variety of objects within a modular wall. In particular, implementations of the present invention can allow an installer to nest such objects within a modular wall without have to add external framework or other aesthetically unpleasing hardware.

Throughout this specification, reference is made to panels of a modular wall system. A panel can comprise an individual section of the modular wall system which a manufacturer can attach and remove independently of other sections of the modular wall system. For example, an existing installed solid wall system that does not include a nested object (such as a window) may be retrofitted with a panel that includes a nested object (such as a window) according to one or more implementations of the present invention by replacing an existing panel in the installed wall without requiring the disassembly of the wall system. The invention, however, is not limited to retrofitting existing walls, but also extends to solid wall installations that include panels with nested objects at the time of initial installation.

As described above, various wall modules, including nested wall modules, can form a modular wall system which can define an individual space, a partition, and/or a barrier. For example, as illustrated in FIG. 1, a modular wall system 100 can incorporate one or more wall modules. The wall modules can comprise face-mounted wall modules 110*a*, center-mounted wall modules 110*b*, or nested wall modules 120*a*, 120*b*, 120*c*, 120*d*. The face-mounted wall modules 110*a* can include a pair of face-mounted panels 130 supported by a frame support. The center-mounted wall modules 110*b* can comprise a center-mounted panel 140 supported by a support frame. The nested wall modules 120*a-d* can have various configurations, incorporating one or more face-mounted panels 130*a-e* as well as one or more center-mounted panels 140*a-d*. Nesting of the face-mounted and center-mounted panels 130*a-e*, 140*a-d* can provide additional functionality as well as desirable aesthetics to the nested wall modules 120*a-d* and to the modular wall system 100.

In one or more implementations, the center-mounted panels 140*a-d* and/or the face-mounted panels 130*a-e* can comprise transparent and/or translucent material, such as thermoplastic resin and/or glass. Accordingly, the center-mounted panels 140*a-d* can allow one to see through the nested wall modules 120*a-d* or center-mounted wall modules 110*b*. In other words, in one or more implementations, the center-mounted panels or tiles 140*a-d* can comprise windows. Additionally, an installer or designer can adjust window area. For instance, the designer can determine the window area based on the shape and size of the transparent or translucent portions of the center-mounted panels 140*a-d*. The designer also can define the window area by adjusting the transparent and/or translucent properties of the transparent and/or translucent material (e.g., by etching a portion of a transparent center-mounted panel 140*a-d*).

Thus, the designer can form the modular wall system 100 to provide a desired level of privacy to the users. In particular, the designer can choose and/or arrange the center-mounted and face-mounted wall modules 110*a, b* and the nested wall modules 120*a-d* in the modular wall system 100, which can determine the window areas. Similarly, the designer can choose and/or arrange the face-mounted panels 130 and the center-mounted panels 140*a-d* in the nested wall modules 120*a-d* to define window areas.

It should be noted, however, that the nested wall modules 120*a-d* can incorporate one or more nested face-mounted panels 130*a-e* and center-mounted panels 140*a-d* for other decorative, aesthetic, and functional purposes. For instance, the center-mounted panels 140*a-d* and/or face-mounted panels 130*a-e* may comprise opaque material thereby preventing visibility through the nested wall modules 120*a-d* entirely. Alternatively, the center-mounted panels 140*a-d* and face-mounted panels 130*a-e* can comprise transparent and/or translucent material, which may allow the user to see through portions of the modular wall system 100.

One will appreciate in light of the disclosure that the nested wall modules 120*a-d* can have almost limitless configurations. For example, the nested wall module 120*a* includes a pair of face-mounted panels 130*a* nested within a center-mounted panel 140*a*. As shown, the center-mounted panel 140*a* can surround and support the pair of face-mounted panels 130*a* nested therein. In one or more implementations, the center-mounted panel 140*a* completely surrounds and supports the pair of face-mounted panels 130*a* nested therein. As explained below, the center-mounted panel 140*a* can comprise a hole within which the pair of face-mounted panels 130*a* are mounted.

One will appreciate that the pair of face-mounted panels 130*a* can comprise any number of different aesthetic or functional purposes. For example, in one or more implementations the nested pair of face-mounted panels 130*a* can comprise an outset aesthetic detail. For example, the nested pair of face-mounted panels 130*a* can comprise a painting, sign (e.g., office name plate, bathroom sign, or other sign). In other implementations, the nested pair of face-mounted panels 130*a* can comprise a fold down shelf or other functional feature.

In contrast to nested wall module 120*a*, nested wall module 120*b* includes a center-mounted panel 140*b* nested within a pair of face-mounted panels 130*b*. As shown, the pair of face-mounted panels 130*b* can surround and support the center-mounted panel 140*b* nested therein. In one or more implementations, the pair of face-mounted panels 130*b* completely surrounds and supports the center-mounted panel 140*b* nested therein. As explained below, the pair of face-mounted panels 130*b* can comprise a hole within which the center-mounted panel 140*b* is mounted.

One will appreciate that the center-mounted panel 140*b* can comprise any number of different aesthetic or functional purposes. For example, in one or more implementations the nested center-mounted panel 140*b* can comprise an inset aesthetic detail. For example, the nested center-mounted panel 140*b* can comprise a painting, sign (e.g., office name plate, bathroom sign, or other sign). Alternatively, the nested center-mounted panel 140*b* can comprise a stain glass window or other aesthetic detail. In other implementations, the nested center-mounted panel 140*b* can comprise a fold down shelf or other functional feature.

In addition to the foregoing, the nested wall modules can include more than one layer of nesting. For example, nested wall module 120*c* includes a pair of face-mounted panels 130*e* nested within a center-mounted panel 140*c*, which in turn is nested within another pair of face-mounted panels 130*c*. As shown, the pair of face-mounted panels 130*c* can surround and support the center-mounted panel 140*c*, which in turn can surround and support the pair of face-mounted panels 130*e*. In yet further implementations, the nested wall modules can include a center-mounted panel nested within a pair of face-mounted panels, which in turn are nested within another center-mounted panel. In still further implementations, the nested wall modules can include three, four, five, or more layers of nesting.

In addition to multiple layers of nesting, one or more implementations of the present invention can also include multiple panels nested within a single panel. For example, the nested wall module 120*d* includes a plurality of center-mounted panels 140*d* nested within a single pair of face-mounted panels 130*d*. Thus, one will appreciate that implementations of the present invention can provide nested wall modules with great aesthetic and functional versatility.

Additionally, as shown by FIG. 1, the nested center-mounted panels 140*b*, 140*c*, 140*d* can have substantially the same shape and size as the shape and size of an opening in the face-mounted panels 130*b*, 130*c*, 130*d* which support the nested center-mounted panels 140*b*, 140*c*, 140*d*. More specifically, a rectangular center-mounted panel 140*c* of a certain size may nest within the face-mounted panels 130*c* that has a rectangular opening of substantially the same size. Hence, the face-mounted panels 130*b*, 130*c*, 130*d* can have a substantially seamless interface with the center-mounted panels 140*b*, 140*c*, 140*d* nested therein. Similarly, nested pairs of face-mounted panels 130*a*, 130*e* can have substantially the same shape and size as the shape and size of an opening in the center-mounted panels 140*a*, 140*c* which support the nested pairs of face-mounted panels 130*a*, 130*e*. Therefore, the center-mounted panels 140*a*, 140*c* can have a substantially seamless interface with one or more nested pairs of face-mounted panels 130*a*, 130*e*.

FIG. 1 illustrates both square and rectangular shaped panels and wall modules. One will appreciate that the present invention is not so limited. In alternative implementations, the center-mounted panels 140*a-d* and/or face-mounted panels 130*a-e*, can include triangular, pentagonal, hexagonal, octagonal, circular, oval, or more complex shapes. Similarly, the wall modules can comprise shapes other than squares or rectangles.

The wall modules 110*a-b*, 120*a-d* can further include a support frame. The support frame can provide structural support to the face-mounted panels 130*a-e* and/or to the center-mounted panels 140*a-d*. In particular, the support frame can support the outermost panels or tiles of the wall module 110*a-b*, 120*a-d*. The support frame of each wall module 110*a-b*, 120*a-d* can comprise a pair of upright supports 150, and one or more cross members extending therebetween. The distance between the upright supports 150 and can define, at least in part, a width of the wall modules 110*a-b*, 120*a d*.

As shown by FIG. 1, in one or more implementations the face-mounted panels 130 can extend across and conceal the support frame supporting them from a facing view. On the other hand, the upright supports 150*a*, 150*b* and cross-members 160*a*, 160*b* of a center-mounted panel 140 may be exposed. In any event, the face-mounted panels 130*a-e* and/or the center-mounted panels 140*a-d* can couple to the upright supports 150 and/or to the cross-members, forming the support frame. As shown by FIG. 1, the face-mounted panels 130*a-e* and/or the center-mounted panels 140*a-d* are secured between the upright supports of their respective wall module 110*a-b*, 120*a-d*.

Figure 2:
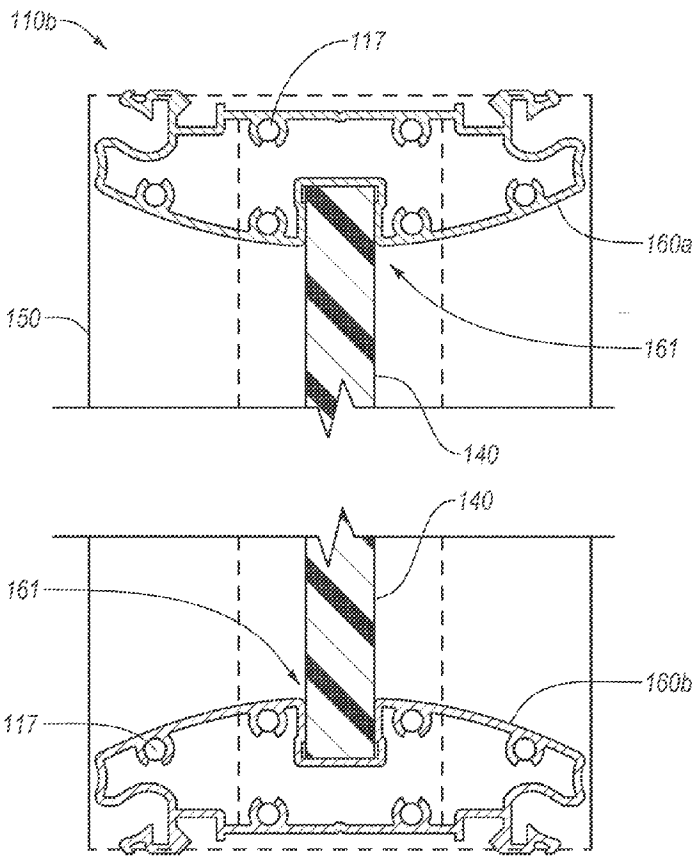
FIG. 2 illustrates a cross-sectional view of a center-mounted wall module of FIG. 1 taken along the line 2-2 of FIG. 1.

For example, FIG. 2 illustrates a cross-sectional view of the center-mounted wall module 110*b*. As shown by FIG. 2, the support frame can comprise an upper cross member 160*a* and a lower cross member 160*b*. The center-mounted panel 140 can extend between the upper cross-member 160*a* and the lower cross member 160*b*. In particular, each of the cross-members 160*a*, 160*b* can include a panel mounting channel 161 sized and configured to hold and support an edge of the center-mounted panel 140. Similarly, the upright supports 150*a*, 150*b* can include panel mounting channels 161 sized and configured to hold and support an edge of the center-mounted panel 140.

One will appreciate that the center-mounted panel of wall modules in which a center-mounted panel 140 is the outermost panel (such as wall modules 110*b* and 120*a*), can include a support frame similar to that shown in FIG. 2. Thus, when a center-mounted panel 140 is the outermost panel, the center-mounted panel can extend between the first and second upright supports 150*a*, 150*b* and between the upper cross-member 160*a* and the lower cross member 160*b*. Thus, the support frame of a nested wall module can directly attach to and support the outermost panel(s) of the nested wall module. As explained below, the outermost panel(s) can then support any nested panels.

Figure 3:
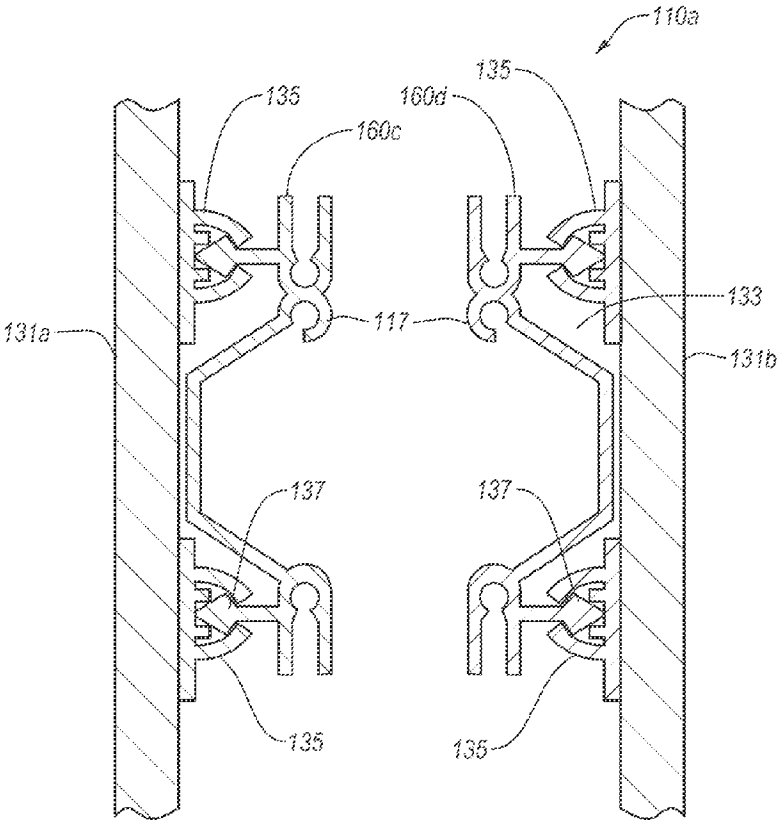
FIG. 3 illustrates a cross-sectional view of a face-mounted wall modules of FIG. 1 taken along the line 3-3 of FIG. 1.

Referring now to FIG. 3, a cross-sectional view of the face-mounted wall module 110*a* of FIG. 1 is shown. The face-mounted wall module 110*a* can incorporate a first face-mounted panel 131*a* (e.g., a front tile) and a second face-mounted panel 131*b* (e.g., a back tile) mounted to opposing sides of the vertical supports 150 and/or of the cross-members 160. Accordingly, the panels 131*a*, 131*b* can define an interior space 133 within the wall module 110*a*.

As shown by FIG. 3, the support frame of the face-mounted wall module 110*a* can include one or more cross-members 160*c*, 160*d*. The cross-members 160*c*, 160*d* can extend between upright supports. The cross-members 160*c*, 160*d* can each include one or more engagement protrusions 137. In one or more implementations, the engagement protrusion 137 comprises an arm with a head attached to the end. For example, FIG. 3 illustrates an arrow-shaped head. The panels 131*a*, 131*b* can in turn include clips or connectors 135 including flexible arms that clip or snap about the head of engagement protrusions 137 to secure the panel 131*a*, 131*b* to the respective cross-member 160*c*, 160*d*. In particular, the flexible arms of the clips 135 can surround at least a portion of the head of the engagement protrusion 137.

The ability to clip the panel 131*a*, 131*b* to a support frame of a wall module 110*a* can allow a user to selectively remove, move, or reconfigure the position of a panel within a given modular wall system. In alternative implementations, the panels 131*a*, 131*b* may not include clips 135. In such implementations, a user can fasten the panels 131*a*, 131*b* directly to the cross-members 160*c*, 160*d* via screws or other fasteners. One will appreciate that such implementations can allow a user to retro fit a given wall module with a nested wall module.

One will appreciate that the face-mounted panels of wall modules in which a pair of face-mounted panels 130 is the outermost panel (i.e., radially outermost relative to the center of the wall module, such as wall modules 120*b-d*), can include a support frame similar to that shown in FIG. 3. Thus, when a pair of face-mounted panels 130 is the outermost panel, the pair of face-mounted panels 130 can mount to the first and second upright supports 150 and to the cross-members 160*c*, 160*d*. Thus, the support frame of a nested wall module can directly attach to and support the outermost panel (s) of the nested wall module. As explained below, the outermost panel(s) can then support any nested panels.

As shown by FIGS. 2 and 3, each of the cross members 160*a-d* can also optionally include one or more mounting holes 117. The mounting holes 117 can allow a user to secure the cross members cross members 160*a-d* to the upright supports 150 or other hardware. Additionally or alternatively, the vertical supports 150 also can include T-slots, and the assembler can insert a double T joining member to join two vertical supports 150. It should be noted, that joining the upright supports 150 of the wall modules 110*a*, 110*b*, 120*a-d*, one to another, can join the respective wall modules 110*a*, 110*b*, 120*a-d* one to another.

Figure 4A:
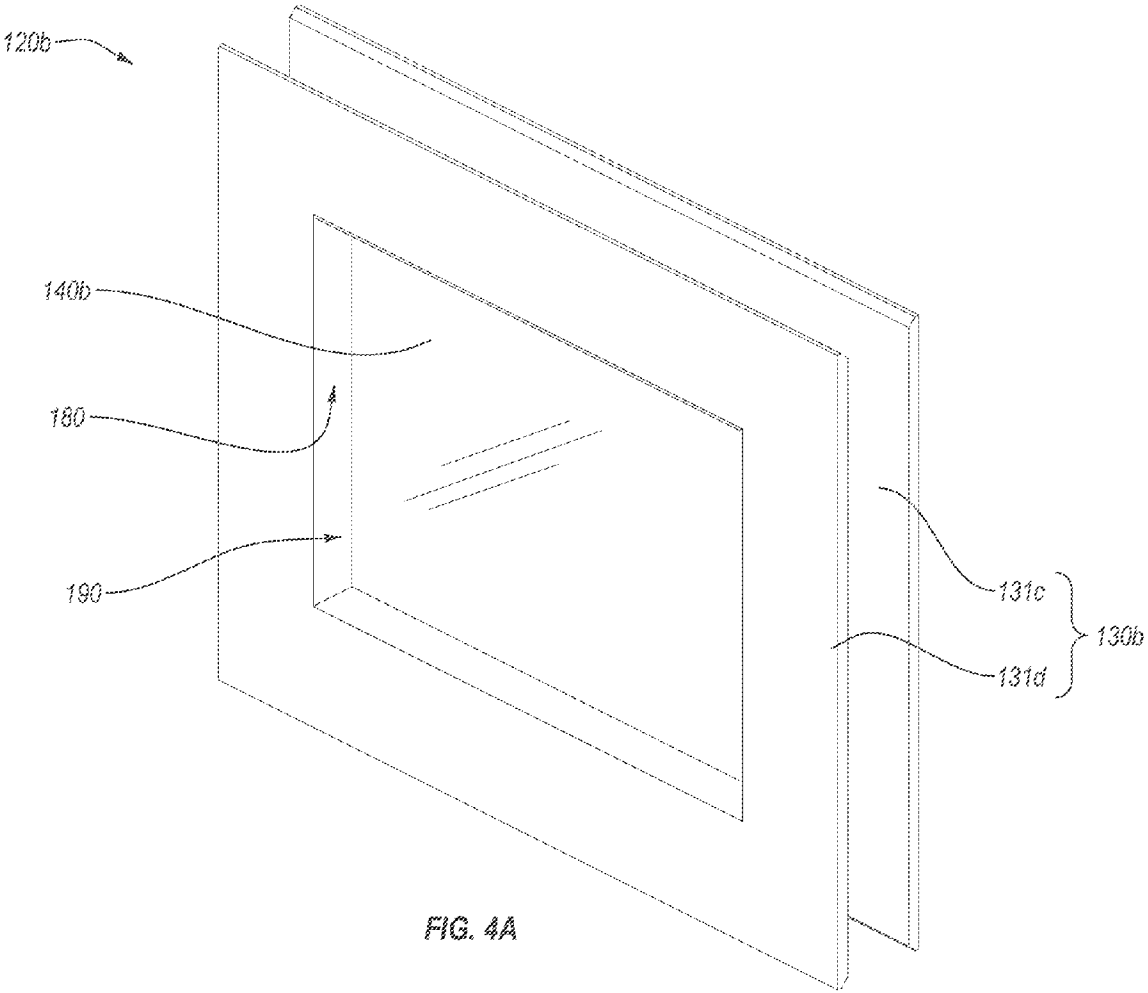
FIG. 4A illustrates a perspective assembled view of a nested wall module having a center-mounted panel nested within a pair of face-mounted panels in accordance with one or more implementations of the present invention.

Referring now to FIGS. 4A-7 the various features and components of nested panels are described in greater detail. For instance, FIGS. 4A and 4B respectively illustrate perspective exploded and assembled views of a portion of a nested wall module 120*b* including a center-mounted panel 140*b* nested within a pair of face-mounted panels 130*b* (including 131*c*, 131*d*). More specifically, the nested wall module 120*b* incorporates the first and the second face-mounted panels 131*c*, 131*d*. The first and the second face-mounted panels 131*c*, 131*d* can include an opening 190, which can accommodate the nested center-mounted panel 140*b*. As described above, the opening 190 can have substantially the same size and/or shape as the center-mounted panel 140*b*. Accordingly, as shown by FIG. 4A, the nested wall module 120*b* can have a substantially seamless interface between the first and the second face-mounted panels 131*c*, 131*d* and the center-mounted panel 140*b*.

A nesting frame assembly 180 can couple the center-mounted panel 140*b* within the hole (i.e., void or opening) 190 and to the face-mounted panels 131*c*, 131*d*. In particular, each of the face-mounted panels 131*c*, 131*d* (i.e., in the pair 130*b*) can attach to the nesting frame assembly 180. The center-mounted panel 140*b* can in turn couple to the nesting frame assembly 180, such that the center-mounted panel 140*b* is entirely supported by the face-mounted panels 131*c*, 131*d* via the nesting frame assembly 180.

Figure 4B:
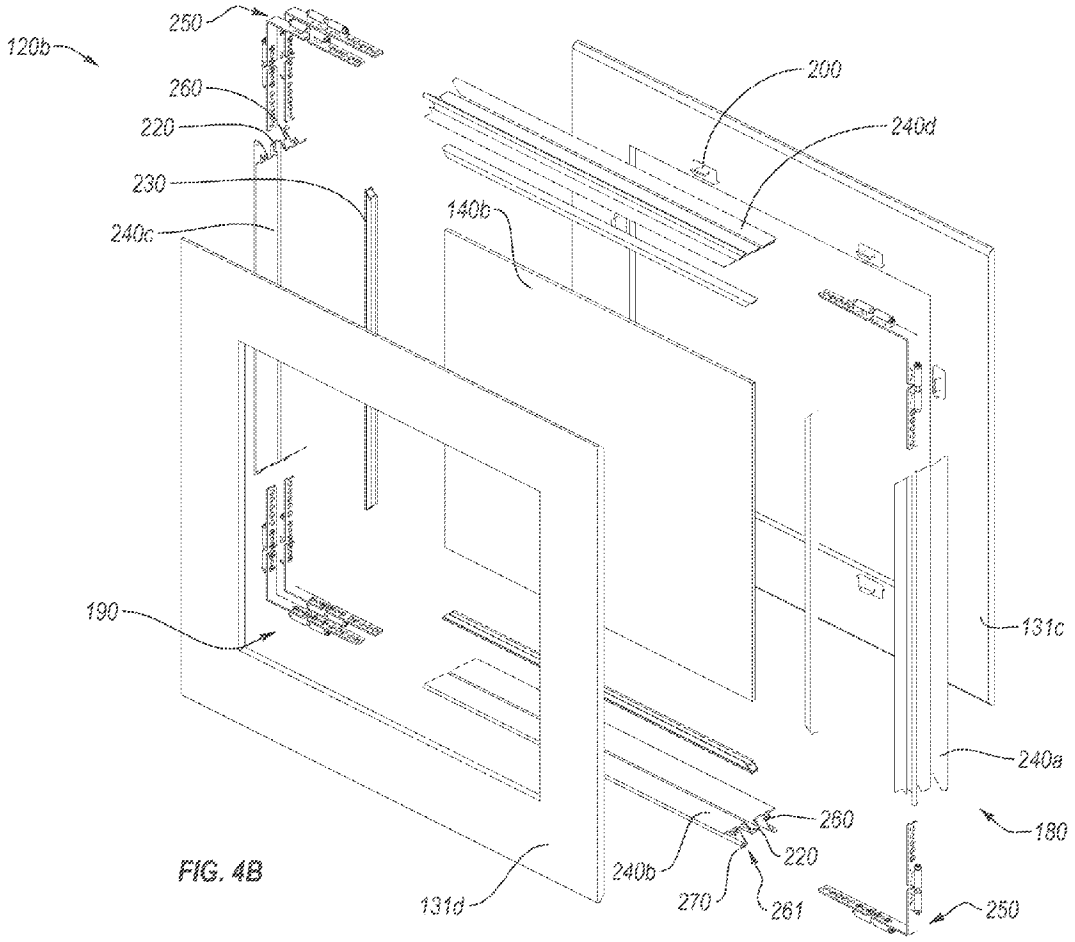
FIG. 4B illustrates an exploded perspective view of the nested wall module of FIG. 4A.

More specifically, referring to FIG. 4B, the nesting frame assembly 180 can include one or more nesting brackets 240*a*, 240*b*, 240*c*, 240*d* (sometimes referred hereinto as window extrusions). The nesting brackets 240*a-d* can comprise any suitable rigid material, such as aluminum, steel, zinc, plastic, etc. In one or more implementations, the manufacturer can extrude a molten material through an extrusion die to form the nesting brackets 240*a-d*. The assembler can connect and/or couple the nesting brackets 240*a-d* one to another to form the nesting frame assembly 180. In one or more implementations, the assembler can use one or more corner cinch assemblies 250 to connect and/or couple the nesting brackets 240*a-d* one to another. For example, the corner cinch assemblies 250 can fit into a cinch channel 260 in the nesting brackets 240*a-d*.

The nesting brackets 240*a-d* can then couple the first and the second face-mounted panels 131*c*, 131*d* and the center-mounted panel 140*b* together. In particular, each nesting bracket 240*a-d* can include a panel channel 220 sized and configured to hold an edge of the center-mounted panel 140*b*. In one or more implementations, the panel channel 220 can also accommodate a glass wipe 230, which can protect and secure the center-mounted panel 140*b* within the panel channel 220.

The nesting brackets 240*a-d* can further include one or more engagement protrusions 270, similar to the engagement protrusions 137 described above. One or more connectors 200 secured to the pair of face-mounted panels 130*b* can in turn attach to the engagement protrusions 270 to couple the pair of face-mounted panels 130*b* to the nesting brackets 240*a-d*. The connectors 200 can couple the pair face-mounted panels 130*b* to the nesting frame assembly 180 (e.g., the connectors 200 can snap into or about an engagement protrusions 137).

In at least one implementation, the nesting brackets 240*a-d* can have mitered ends 261, which can form a desired angle between the nesting brackets 240*a-d* when the corner cinch assembly 250 couples one nesting bracket 240*a-d* to another nesting bracket 240*a-d*. For instance, the nesting brackets 240*a* and 240*b* can have 45° mitered ends 261. Accordingly, when the corner cinch assembly 250 couples the nesting bracket 240*a* to the nesting bracket 240*b*, the coupled nesting brackets 240*a*, 240*b* form a 90° angle therebetween.

The nesting brackets 240*a-d* also can have mitered ends 261 that can result in non-transversely aligned coupled nesting brackets 240*a-d*. For instance, the nesting brackets 240*a* and 240*b* can have mitered ends 261 that have 35° angles. Accordingly, when the corner cinch assembly 250 couples the nesting brackets 240*a* and 240*b* the coupled nesting brackets 240*a*, 240*b* can form a 70° angle therebetween. Hence, the manufacturer or assembler can couple the nesting brackets 240*a-d* one to another at substantially any desired angle, for example, by choosing a desired angle for the mitered ends 261 of the nesting brackets 240*a-d*.

Furthermore, as described above, the nesting frame assembly 180 can include multiple nesting brackets 240*a-d*. For instance, the nesting frame assembly 180 can include four nesting brackets 240*a*, 240*b*, 240*c*, 240*d* as shown in FIG. 4B. Where the installer desires to form the nesting frame assembly 180 that has a substantially rectangular shape, the installer can couple together four nesting brackets 240*a-d*, which have mitered ends 261 at 45° angles. The installer also can form the nesting frame assembly 180 that has other shapes using a similar technique, by choosing a desired number of the nesting brackets 240*a-d* and by choosing the appropriate angles for the mitered ends 261. For example, the installer can form a triangular nesting frame assembly 180 by coupling three nesting brackets that have mitered ends 261 at 30° angles.

Thus, the nesting frame assembly 180 can have various shapes, which may include nonlinear segments. For example, one or more nesting brackets may have nonlinear configuration (e.g., arcuate, bent, irregular shaped, etc). Accordingly, the nesting frame assembly 180 can have a circular, elliptical, irregular, as well as any other desired shape. Similarly, the nested face-mounted panels 130 and/or center-mounted panels 140*a* also can have substantially any desired shape, which may correspond with the shape of the nesting frame assembly 180.

Figure 5:
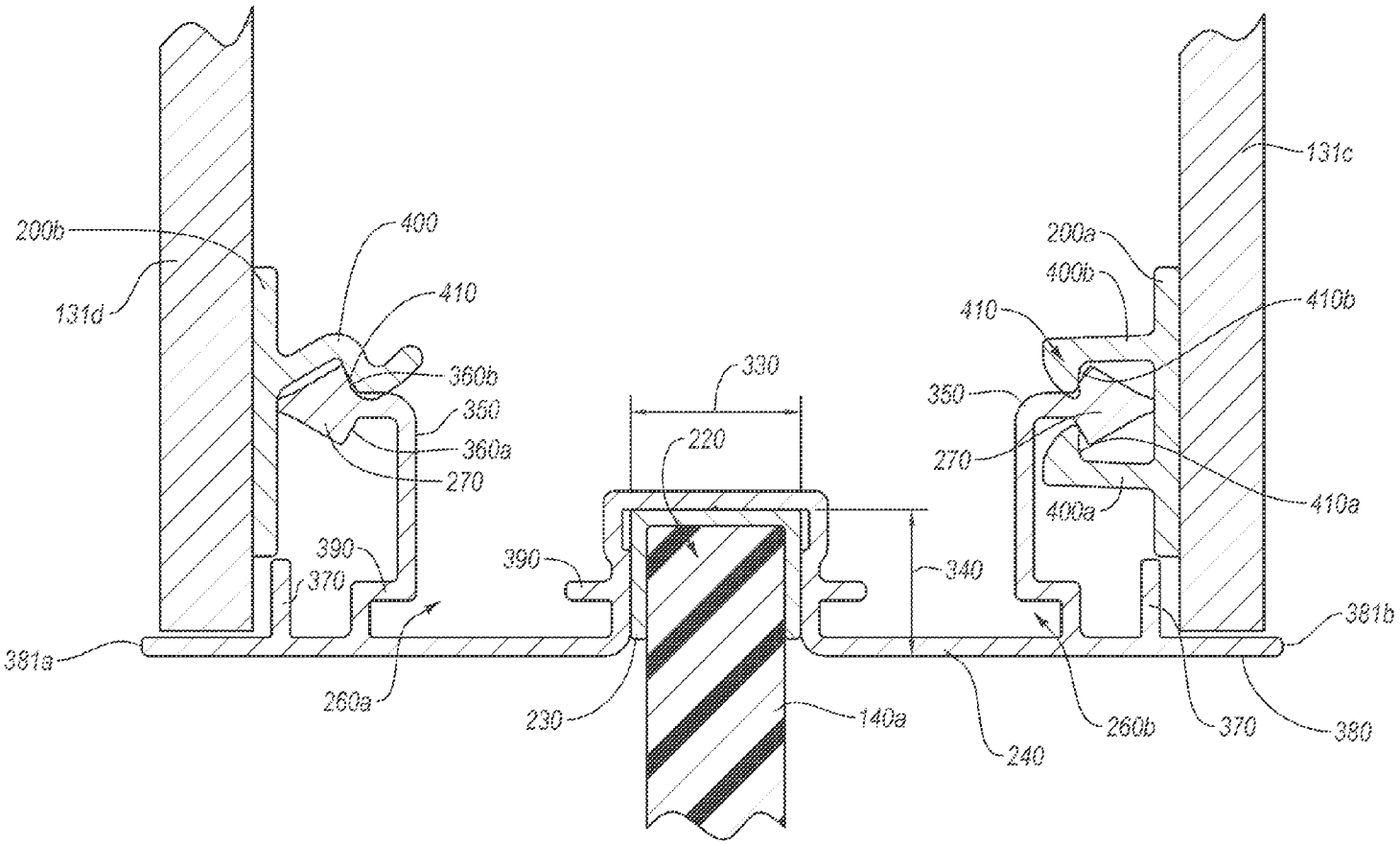
FIG. 5 illustrates a cross-sectional view of a bracket of a nested frame assembly in accordance with one or more implementations of the present invention.

Referring now to FIG. 5, the nesting brackets 240*a-d* and how they attach to the face-mounted panels 130 and the center-mounted panel 140*a* is described in greater detail. For example, as illustrated in FIG. 5, the nesting brackets 240 can include a panel channel 220 for receiving and holding and edge of a center-mounted panel 140*a*. In particular, the profile of the nesting bracket 240 can include an undercut 320 that that defines the panel channel 220.

The undercut 320 can comprise a generally u-shaped channel. The undercut 320 can extend away from a front surface or face 380 of the nesting bracket 240. In one or more implementations, the panel channel 220 is in the middle of the nesting bracket 240 between opposing ends 381*a*, 381*b* as shown by FIG. 5. Alternatively, the panel channel 220 is located at other positions within the depth of the nested wall module. One will appreciate that the position of the panel channel 220 dictates the position of the center-mounted panel 140*a* relative to the face-mounted panels 131*c*, 131*d*. Thus, in one or more implementations the panel channel 220 is located proximate an end 381*a*, 381*b* of the nesting bracket 240. In such implementations, the center-mounted panel 140*a* will be positioned proximate one of the face-mounted panels 131*c*, 131*d* rather than being positioned between them.

Furthermore, while the FIGS. illustrate that the nesting brackets 240 have a single panel channel 220, the present invention is not so limited. In alternative implementation, the nesting bracket 240 can include two, three, or more panel channels 220, and thus, hold more than one the center-mounted panel 140*a*. For example, in one or more implementations the nesting bracket 240 includes two panel channels 200, which each hold a center-mounted panel 140*a*. A gap between the center-mounted panels 140*a* can act as insulation or a sound barrier.

In one or more implementations, the panel channel 220 can have a width 330, which can accommodate the center-mounted panels 140*a* and/or the glass wipe 230. For example, the panel channel 220 can have the width 330 the same as an outer width of the glass wipe 230. Accordingly, the panel channel 220 can secure the glass wipe 230 and the center-mounted panel 140*a* to the nesting bracket 240. Alternatively, the panel channel 220 can have the width 330 that may be larger or smaller than the width of the glass wipe 230. For instance, the panel channel 220 can have the width 330 that is slightly smaller than the width of the glass wipe 230. Thus, the glass wipe 230 and/or the center-mounted panel 140*a* can have an interference fit within the panel channel 220. For example, when the panel channel 220 has a width 330 that is slightly smaller than the width of the glass wipe 230, the glass wipe 320 can apply pressure and squeeze about the center-mounted panel 140*a* to hold the center-mounted panel 140*a* within the panel channel 220.

The panel channel 220 also can have a depth 340, which can accommodate the glass wipe 230 and a portion of the center-mounted panel 140*a* therein. In one or more implementations the depth 340 of the panel channel can be between about ⅛ an inch and about 1 inch. In alternative implementations, the depth 340 of the panel channel 220 can be greater or smaller.

The glass wipe 230 can comprise an elastomeric material, such as natural or synthetic rubber or another resilient material. Accordingly, the glass wipe 230 can provide shock absorption to the center-mounted panel 140*a*, which may reduce accidental breakage of the center-mounted panel 140*a* in response to impact. The glass wipe 230 also can deform about the center-mounted panel 140*a*, which may improve coupling of the center-mounted panel 140*a* to the nesting bracket 240.

Additionally or alternatively, the glass wipe 230 can form a seal between the center-mounted panel 140*a* and the nesting frame assembly 180, which may provide improved sound dampening as well as thermal insulation properties of the wall modules. Such improved sound dampening properties for the nested wall modules 120 may result in reduced amount of noise that may be heard by occupants of the individual space created by the modular wall system 100. Similarly, improved thermal insulation of the nested center-mounted panel 140*a* can allow the occupants of one or more individual spaces defined by the modular wall system 100 to better control temperature within such individual spaces.

As mentioned previously, the nesting brackets 240 also can incorporate one or more engagement protrusions 270. In particular, as illustrated by FIG. 5, an L-shaped arm 350 can extend away from the face 380 of the nesting bracket 240. Each arm 350 can hold an engagement protrusion 270 at the end thereof. The L-shaped arms 350 can point each of the engagement protrusions 270 away from the panel channel 220, and away from each other. As shown by FIG. 5, the engagement protrusions 270 may not extend all the way to the ends 381*a*, 381*b* of the nesting bracket 240. This can allow the ends 381*a*, 381*b* of the nesting bracket 240 to cover the ends of the face-mounted panels 131*c*, 131*d*.

As shown by FIG. 5, the nesting bracket 240, and particularly the engagement protrusions 270 and panel channel 220 can hold the panels 140*a*, 131*c*, 131*d*, such that the center-mounted panel 140*a* extends in a first direction from the nesting bracket 240, and the face-mounted panels 131*c*, 131*d* extend from the nesting bracket 240 in a second opposing direction. One will appreciate that this can allow for the nesting of panels.

In one or more implementations, the engagement protrusion 270 can comprise a barb or an arrow-shaped head. The panels 131*c*, 131*d* can in turn include clips or connectors 200*a*, 200*b* including one or more flexible arms 400, 400*a*, 400*b* that clip or snap about the head of engagement protrusion 270 to secure the panels 131*c*, 131*d* to the nesting bracket 240. In particular, the flexible arms or prongs 400, 400*a*, 400*b* of the connectors 200*a*, 200*b* can surround at least a portion of the head of the engagement protrusion 270.

The ability to clip the panels 131*b*, 131*c* to the nesting bracket 240 can allow a user to selectively remove, move, or reconfigure the position a panel within a given modular wall system. In alternative implementations, the panels 131*c*, 131*d* may not include connectors 200*a*, 200*b*. In such implementations, a user can fasten the panels 131*c*, 131*d* directly to the nesting bracket 240 via screws or other fasteners. One will appreciate that such implementations can allow a user to retro fit a given wall module with a nested wall module.

As shown by FIG. 5, engagement protrusions or barbs 270 can include one or more undercutting edges 360*a*, 360*b*. Accordingly, the undercutting edges 360*a*, 360*b* of the engagement protrusions or barbs 270 can couple the corresponding portions of the connectors 200*a*, 200*b*. In particular, connectors 200*a*, 200*b* can have one or more flexible arms or prongs 400, 400*a*, 400*b* that may incorporate one or more undercutting lips 410 (e.g., prongs can incorporate undercutting lips 410*a*, 410*b*, respectively). Thus, the undercutting edges 360*a*, 360*b* of the engagement protrusions or barbs 270 can mate with one or more undercutting lips 410 of the flexible arms or prongs 400, 400*a*, 400*b*. For instance, the flexible arms or prongs 400, 400*a*, 400*b* can flex outward to allow the undercutting lips 410 to move around the undercutting edges 360*a*, 360*b* of the flexible arms or prongs 400, 400*a*, 400*b* so the undercutting edges 360*a*, 360*b* can snap into the connectors 200*a*, 200*b*.

Mechanical or other fasteners can couple the connectors 200*a*, 200*b* to the face-mounted panels 131*c*, 131*d* (e.g., screws, bolts, glue, Velcro, welding, such as ultrasonic welding, etc.). Alternatively, a dowel can extend from the back surface of the connector 200*a*, 200*b* into a corresponding hole within the face-mounted panels 131*c*, 131*d*. Such dowels can provide location and orientation for the connectors 200*a*, 200*b* on the face-mounted panels 131*c*, 131*d* and vice versa. Therefore, by locating the connectors 200*a*, 200*b* at predetermined locations on the face-mounted panels 131*c*, 131*d*, the assembler can ensure that the connectors 200*a*, 200*b* properly align with engagement protrusions or barbs 270 of the nesting bracket 240.

The nesting bracket 240 also can include one or more standoffs 370. The standoffs 370 can protrude outward from the face 380 of the nesting brackets 240. In one or more implementations, the standoffs 370 can locate the nesting brackets 240, and consequently the nesting frame assembly 180, with respect to the connectors 200*a*, 200*b*. Additionally or alternatively, the standoffs 370 can rest on at least a portion of the connectors 200*a*, 200*b*, thereby providing additional support to the nesting brackets 240. For example, by supporting the nesting brackets 240 oriented horizontally.

Additionally, he nesting brackets 240 can include one or more cinch channels 260 (e.g., such as cinch channels 260*a*, 260*b* shown in FIG. 5). The cinch channels 260*a*, 260*b* can accommodate one or more fastening elements that can couple to or more nesting brackets 240 together. For example, the cinch channels 260*a*, 260*b* can accommodate and secure the corner cinch assemblies 250 therein. More specifically, the cinch channels 260 can have a T-slot shape defined by lips 390. The lips 390 can secure one or more portions of the corner cinch assemblies 250 within the cinch channels 260*a*, 260*b*.

In particular, the cinch channel 260*a*, 260*b* can have a T-slot shape, such that the installer can secure the corner cinch assemblies 250 within the cinch channel 260*a*, 260*b*. Additionally or alternatively, the installer can couple one nesting bracket 240 to another nesting bracket 240 using fasteners, straps, and/or other mechanical connections. Moreover, the installer also can weld the nesting brackets 240 together, thereby forming a desired coupling therebetween.

Figure 6A:
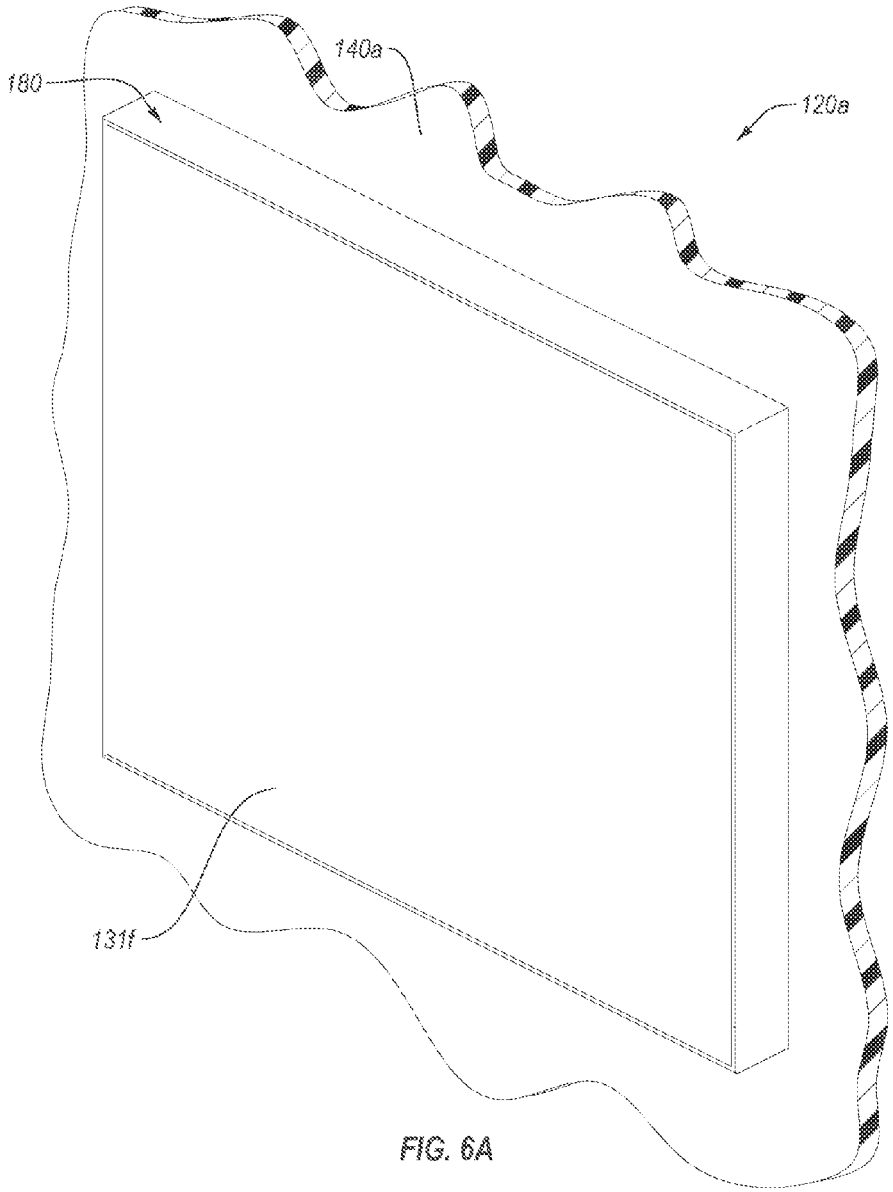
FIG. 6A illustrates a perspective assembled view of a nested wall module having a pair of face-mounted panels nested within a center-mounted panel in accordance with one or more implementations of the present invention.

In addition to nesting a center-mounted panel within face-mounted panels, the nesting frame assembly 180 can also nest face-mounted panels within a center-mounted panel. For example, FIGS. 6A and 6B respectively illustrate perspective exploded and assembled views of a portion of a nested wall module 120*a* including a pair of face-mounted panels 131*e*, 131*f* nested within a center-mounted panel 140*a*. More specifically, the nested wall module 120*a* can include a center-mounted panel 140*a* including an opening 280 (FIG. 6B), which can accommodate the nested face-mounted panels 131*e*, 131*f*. As described above, the opening 280 can have substantially the same size and/or shape as the face-mounted panels 131*e*, 131*f*. Accordingly, as shown by FIG. 6A, the nested wall module 120*a* can have a substantially seamless interface between the first and the second face-mounted panels 131*e*, 131*f* and the center-mounted panel 140*a*.

The nesting frame assembly 180 can couple the face-mounted panels 131*e*, 131*f* within the hole of the center-mounted panel 140*a*. In particular, the each of the face-mounted panels 131*e*, 131*f* can attach to the nesting frame assembly 180. The center-mounted panel 140*b* can in turn couple to the nesting frame assembly 180, such that the face-mounted panels 131*e*, 131*f* are entirely supported by the center-mounted panel 140*a* via the nesting frame assembly 180.

In at least one implementation, nesting brackets 240*a-d* of the nesting frame assembly 180 can couple the center-mounted panel 140*b* to the face-mounted panels 131*e*, 131*f*. In particular, panel channels 220 in the nesting brackets 240*a-d* can hold and secure the center-mounted panel 140*b* in a similar manner as described above. Also, connectors 200 secured to the face-mounted panels 131*e*, 131*f* can couple to engagement protrusions or barbs 270 on the nesting brackets

240*a-d* in a similar manner as described above. Thus, the assembler can use one or more of the same elements for nesting the face-mounted panels 131*e*, 131*f* within a center-mounted panel 140*a* as for the configuration described above (i.e., nesting a center-mounted panel 140*b* within face-mounted panels 130*b*).

In particular, the irrespective of whether the face-mounted panels nest within a center-mounted panel or the center-mounted panel nests within the face-mounted panels, the assembler can use the same nesting frame assembly 180 (nesting brackets 240 etc.). Accordingly, the manufacturer may reduce production cost associated with making the nesting frame assembly 180 for various nesting configurations. In particular, the manufacturer need only flip the nesting brackets 240 to change the configuration.

Figure 6B:
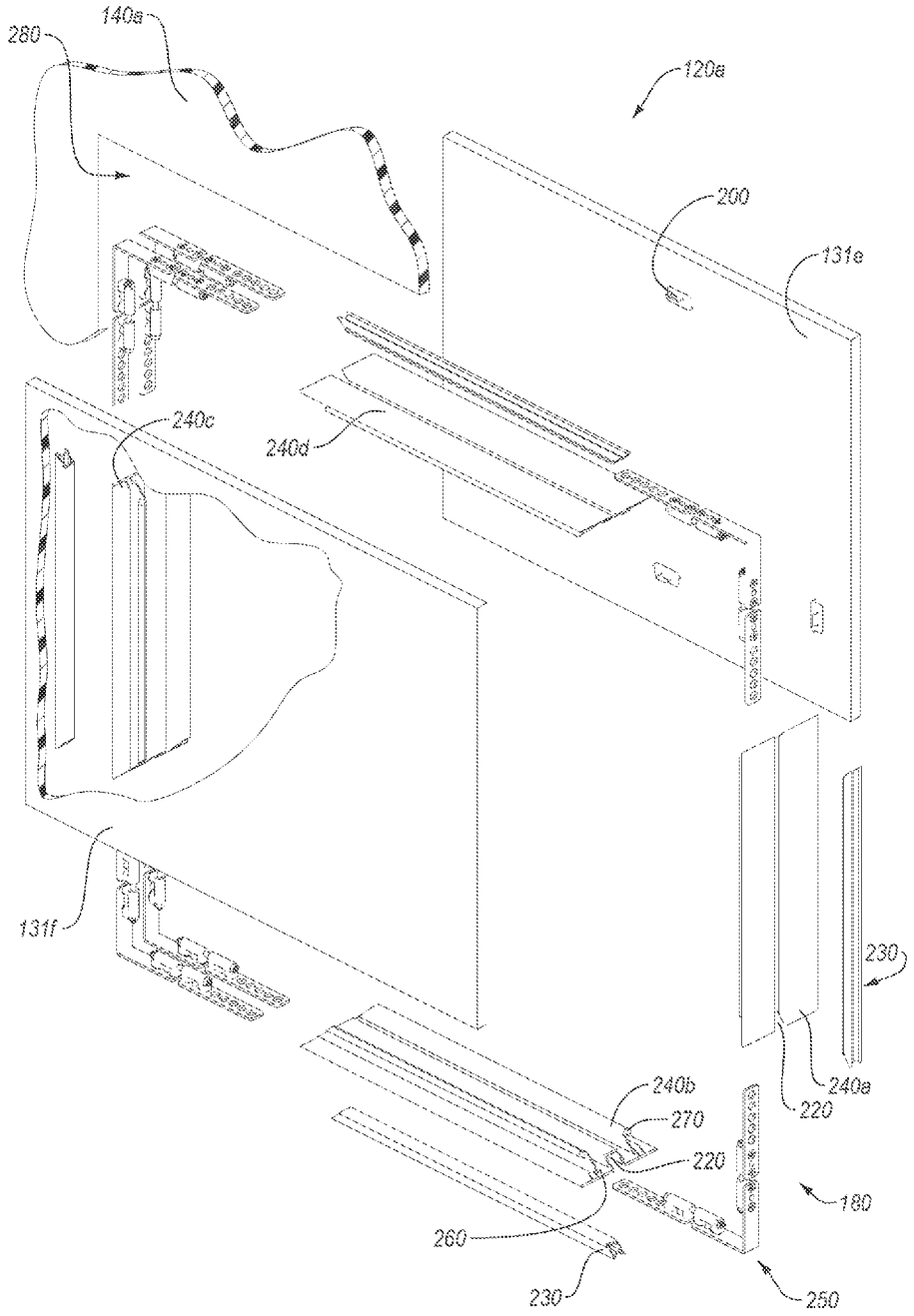
FIG. 6B illustrates an exploded perspective view of the nested wall module of FIG. 6A.

Accordingly, as shown by FIG. 6B, to nest face-mounted panels 131*e*, 131*f* within a center-mounted panel 140*b*, the manufacturer or assembler can form the nesting frame assembly 180 that has a plurality of nesting brackets 240*a-d* with the panel channel 220 facing outward. Thus, the assembler can secure face-mounted panels 131*e*, 131*f* within an opening 280 of the center-mounted panel 140*b*.

Figure 7B:
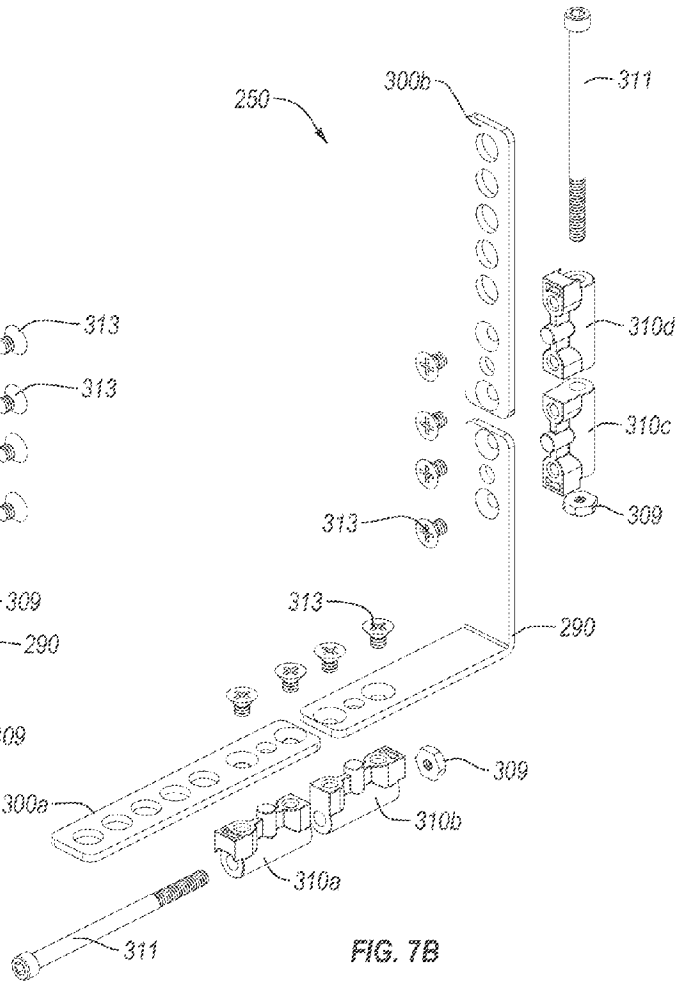
FIG. 7B illustrates an exploded view of the cinch assembly of FIG. 6A in a second configuration in accordance with another implementation of the present invention.
Figure 7A:
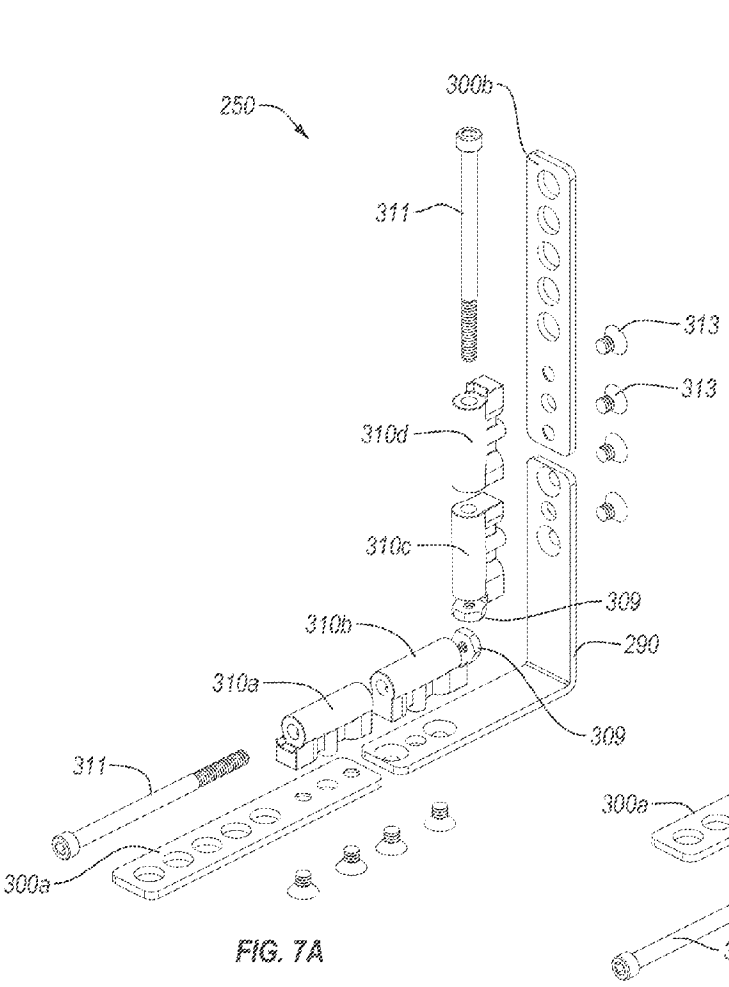
FIG. 7A illustrates an exploded view of a cinch assembly in a first orientation in accordance with one or more implementations of the present invention.

In one or more implementations, as described above, the assembler can use the same corner cinch assembly 250 for various nesting combinations of the face-mounted panels and center-mounted panels. For example, FIGS. 7A and 7B illustrate exploded views of a corner cinch assembly 250 in accordance with one or more implementations of the present invention. For example, as illustrated in FIGS. 7A and 7B, the corner cinch assemblies 250 can include a corner cinch plate 290 and one or more inline cinch plates 300*a*, 300*b*. The corner cinch assembly 250 also can include one or more cinch couplings or castings 310*a*, 310*b*, 310*c*, 310*d*.

An assembler can attach the cinch couplings or castings 310*a*, 310*b*, 310*c*, 310*d* to the cinch plates 300*a*, 300*b*, 290 via a plurality of fasteners, such as screws 313. For example, an assembler can attach a cinch casting 310*a* to and end of inline cinch plate 300*a*. In particular, the cinch couplings 310*a*, 310*b*, 310*c*, 310*d* can each comprise a plurality of mounting holes for receiving the screws 313. The assembler can also attach cinch casting 310*b* to the corner cinch plate 290.

The assembler can then use connecting hardware, such as cinch screw 311, to cinch together the cinch plates 310*b*, 290 to pull the nesting brackets 240 (to which the inline and/or corner cinch plates are attached via the additional holes in the plates) into the proper position. In particular, the manufacturer can thread the cinch screw 311 through a mounting shaft in the particular cinch casting 310*a* and into a mounting shaft of the adjacent cinch casting 310*b*. The mounting shafts of the cinch couplings or castings 310*a*, 310*b*, 310*c*, 310*d* can be oriented at approximately 90 degrees relative to the mounting holes for receiving the screws 313.

Thus, coupling the cinch couplings 310*a* and 310*b*, for example, can force the cinch plate cinch plate 300*a* and the corner cinch plate 290 closer together. Similarly, coupling the cinch couplings 310*c* and 310*d* can force the cinch plate 300*b* and the corner cinch plate 290 closer together. Hence, the corner cinch assemblies 250 can force the mitered ends 270 of the nesting brackets 240 closer together, by tightening the cinch screw 311 that couple the cinch couplings 310*a*, 310*b*, 310*c*, 310*d* together.

Moreover, the assembler can couple the cinch couplings cinch couplings 310 to an inside portion of the corner cinch plate 290 (FIG. 7A). Alternatively, the assembler can couple the cinch couplings 310*a*, 310*b*, 310*c*, 310*d* to an outside portion of the corner cinch plate 290 (FIG. 7B). When the cinch couplings 310*a*, 310*b*, 310*c*, 310*d* are on the inside of the cinch plates 300*a*, 300*b*, the cinch assembly 250 can couple together nesting brackets 240 for use in nesting face-mounted panels within a center-mounted panel as shown by FIG. 6B. When the cinch couplings 310*a*, 310*b*, 310*c*, 310*d* are on the outside of the cinch plates (FIG. 7B), the cinch assembly 250 can couple together nesting brackets 240 for use in nesting a center-mounted panel within a pair of face-mounted panels as shown by FIG. 4B.

As described above, however, the assembler can use other mechanical couplers to connect, couple, and secure the nesting brackets 240 together, thereby forming the nesting frame assembly 180. For example, the nesting brackets 240 can incorporate screw channels that can receive threaded fasteners (e.g., self-tapping screws). Thus, the assembler can screw the nesting brackets 240 one to another, thereby coupling the nesting brackets 240 to form the nesting frame assembly 180.

Moreover, as described above, the nesting frame assembly 180 can have various shapes, formed by multiple nesting brackets 240, which can couple one to another at various angles. Accordingly, the corner cinch plate 290 also can have various angles, which can accommodate coupling the nesting brackets 240 at respective angles. For instance, the corner cinch plate 290 can have a 90° angle, which can facilitate securing the nesting brackets 240 at a 90° angle (e.g., to form a rectangular nesting frame assembly 180). Alternatively, the corner cinch plate 290 can have any other angle that can correspond to the angle formed between nesting brackets 240.

In any event, implementations of the present invention can allow for the nesting of face- and center-mounted panels into wall modules. For instance, the nested wall modules can include one or more center-mounted panels nested within face-mounted panels. In at least one implementation, the nested wall module can include face-mounted panels that have one or more center-mounted panels nested therein. Similarly, the nested wall module can include one or more center-mounted panels having a pair of face-mounted panels nested therein. In one or more implementations, the nested wall module also can have a plurality of alternating face-mounted and center-mounted panels nested one within the other. Furthermore, the nested wall module can incorporate multiple and alternating face-mounted and center-mounted panels nested one within the other. One will also appreciate in light of the disclosure herein that the hardware and systems of the present invention can allow an installer to quickly and easily retrofit an existing non-nested wall module with a nested wall module.

Figure 8:
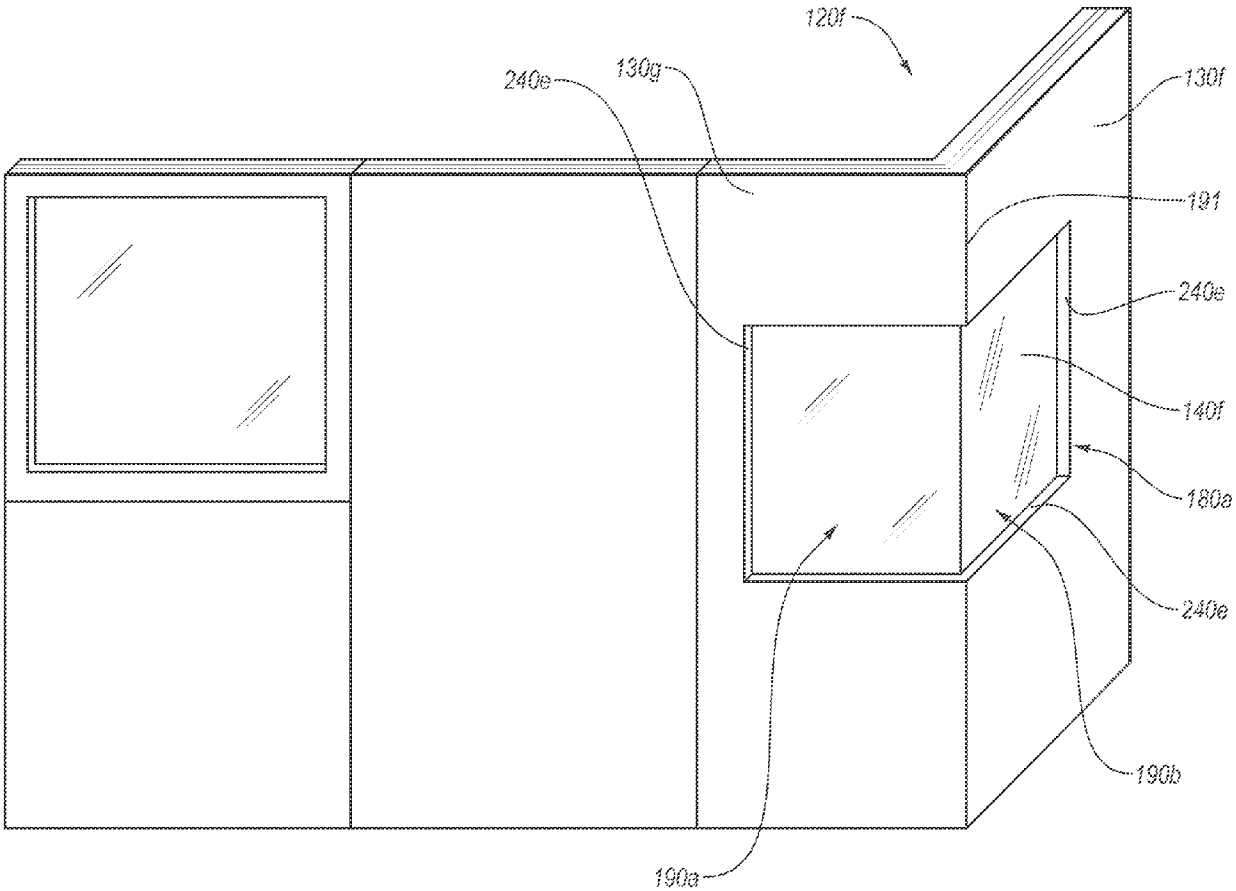
FIG. 8 illustrates a perspective view of another modular wall system incorporating nested wall modules in accordance with one or more implementations of the present invention.

One will appreciate that the implementations shown in FIGS. 1-7B are only exemplary implementations, and the systems, components, and methods of the present invention can allow for a wide variety of different nested wall module configurations. For example, FIG. 8 illustrates a corner nested wall module 120*f*. The corner nested wall module 120*f* can comprise a corner center-mounted panel 140*f* nested within two pairs of face-mounted panels 130*f*, 130*g*. In particular, the pair of face-mounted panels 130*g* can include a hole or opening 190*a* that extends to the corner 191. Similarly, the pair of face-mounted panels 130*f* can include a hole or opening 190*b* that extends to the corner 191. In other words, both of the openings 190*a*, 190*b* can be open ended, in other words a side of the openings 190*a*, 190*b* is not enclosed by the pairs of face-mounted panels 130*f*, 130*g*.

The corner center-mounted panel 140*f* can reside within the openings 190*a*, 190*b*. As shown, the corner center-mounted panel 140*f* can be devoid of hardware or frame components extending along the corner of the corner center-mounted panel 140*f*. The pairs of face-mounted panels 130*f*, 130*g* can surround and support the corner center-mounted panel 140*f* nested therein.

In particular, a nesting frame assembly 180*a* can couple the corner center-mounted panel 140*f* within the pairs of face-mounted panels 130*f*, 130*g*. In particular, a plurality of nesting brackets 240*e* can seamlessly couple the corner center-mounted panel 140*f* within the pairs of face-mounted panels 130*f*, 130. As with the other illustrated implementations of nested wall modules, the nested component (i.e., corner center-mounted panel 140*f*) may couple directly to the pairs of face-mounted panels 130*f*, 130*g*, and not to the frame components (see FIGS. 2 and 3) supporting the pairs of face-mounted panels 130*f*, 130*g*.

While FIGS. 1-8 illustrate the nesting of either center-mounted panels within face-mounted panels or vice versa, the present invention is not so limited. In particular, as alluded to earlier, implementations of the present invention can further include the nesting of shadow boxes, an inset or outset aesthetic details, passthroughs (i.e., a hole through the modular wall), functional components (e.g., a shelf, a desktop), or other objects. In any event, in at least one implementation, the nested object is supported by the panel(s) within which it is nested and not to any frame components supporting such panel(s).

Figure 9:
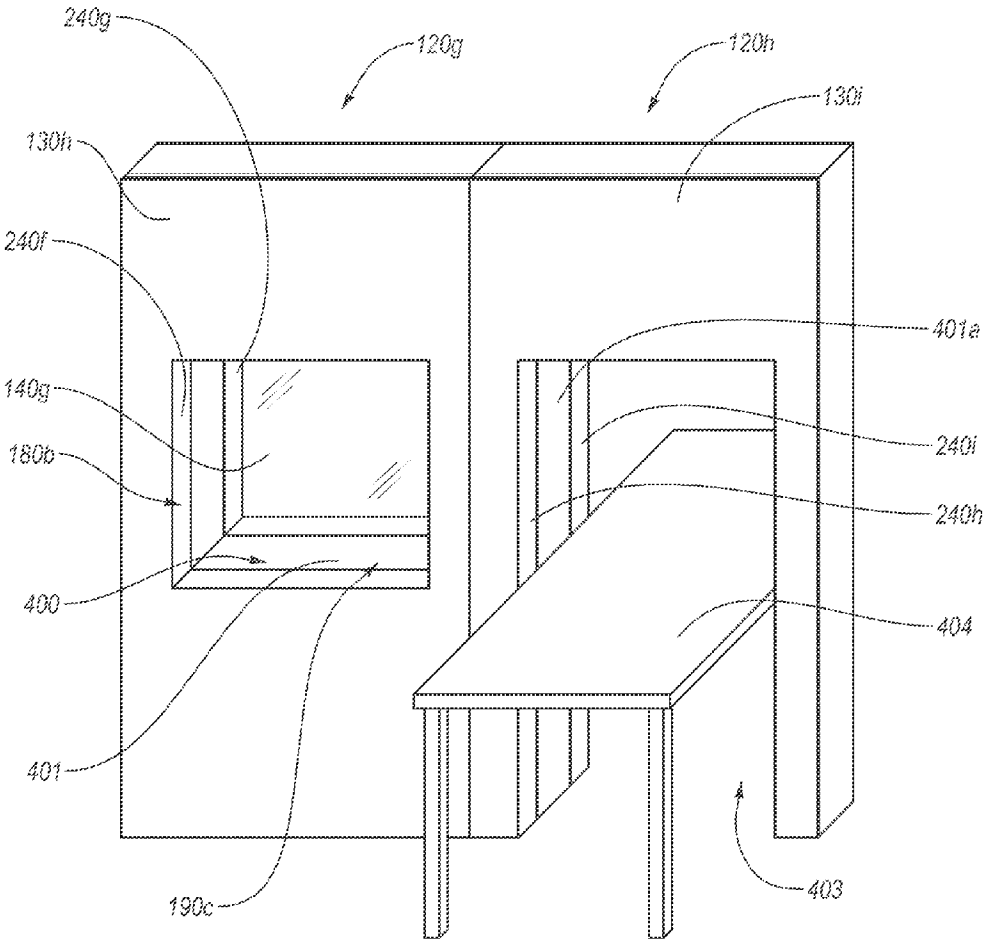
FIG. 9 illustrates a view of yet another modular wall system incorporating nested wall modules in accordance with one or more implementations of the present invention.

For instance, FIG. 9 illustrates two additional nested wall modules 120*g*, 120*h* according to one or more implementations of the present invention. In particular, nested wall module 120*g* comprises a shelf 400 and a backset panel 140*g*. Each of the shelf 400 and the backset panel 140*g* are nested within a pair of face-mounted panels 130*h*. In particular, a nesting frame assembly 180*b* and couple the shelf 400 and backset panel 140*g* to the pair of face-mounted panels 130*h*.

In particular, each side of the opening 190*c* can include a front nesting bracket 240*f* and a back nesting bracket 240*g*. A finishing cap 401 can extend between the front nesting bracket 240*f* and the back nesting bracket 240*g*. In particular, the finishing cap 401 can include one or more protrusions sized and configured to mate with a panel channel (see FIG. 5) in each of the front nesting bracket 240*f* and the back nesting bracket 240*g* and span between the front nesting bracket 240*f* and the back nesting bracket 240*g*. Alternatively, the finishing cap 401 can mate with a single panel channel in one of the front nesting bracket 240*f* and the back nesting bracket 240*g* and extend across to the other of the front nesting bracket 240*f* and the back nesting bracket 240*g*. In any event, together the front nesting bracket 240*f*, the back nesting bracket 240*g*, and the finishing cap 401 can form a shelf 401 within the opening 190*c*.

FIG. 9 further illustrates that the nested wall module 120*g* can include a backset panel 140*g*. The backset panel 140*g* can reside within a panel channel of the back nesting brackets 240*g*. One will appreciate that in one or more implementations each of the back nesting brackets 240*g* can include at least two panel channels. One panel channel can hold the backset panel 140*g*, while the other can hold a portion of the finishing cap 401. One will appreciate that the panel channels of the back nesting brackets 240*g* may not be centered. Indeed, they may be positioned toward the end 381*a*, 381*b* (see FIG. 5) of the back nesting brackets 240*g*.

In one or more implementations, the nested wall module 120*g* may not include the backset panel 140*g*. In such implementations, the nested wall module 120*g* can nest a passthrough. In other words, no objects except the finishing cap 401 can be positioned within the opening 180*b*. Thus, the opening 180*b* can extend completely through the nested wall module 120*g* from the front side to the back side.

In still further implementation, the nested wall module 120*g* can include a backset panel 140*g* and a front set panel. The front set panel can couple to the front nesting brackets 240*f*, just as the backset panel 140*g* couples to the back nesting brackets 240*g*. The space between the frontset panel and backset panel 140*g* can function as a display case or other functional space.

Referring now to the nested wall module 120*h*, as shown the nested wall module 120*h* comprises a nested passthrough 403. In particular, the passthrough 403 is nested within a pair of face-mounted panels 130*i*. In particular, a nesting frame assembly including a plurality of nesting brackets 240*h*, 240*i* can define a passthrough that extends through the nested wall module 120*h*.

In particular, each side of the passthrough 403 can include a front nesting bracket 240*h* and a back nesting bracket 240*i* A finishing cap 401*a* can extend between the front nesting bracket 240*h* and the back nesting bracket 240*i*. In particular, the finishing cap 401*a* can include one or more protrusions sized and configured to mate with a panel channel (see FIG. 5) in each of the front nesting bracket 240*h* and the back nesting bracket 240*i* and span between the front nesting bracket 240*h* and the back nesting bracket 240*i* In any event, together the front nesting bracket 240*h*, the back nesting bracket 240*i*, and the finishing cap 401*a* can define the borders of the pass through 403.

As shown in FIG. 9, the passthrough 403 can extend to the bottom edge of the nested wall module 120*h*. This can allow a table 404 or other object to move in and out of the passthrough 403. One will appreciate in light of the disclosure herein that the nesting frame assembly can allow for passthroughs of a wide variety of shapes, locations, and sizes.

The present invention may be embodied in other specific forms without departing from its spirit or essential characteristics. The described embodiments are to be considered in all respects only as illustrative and not restrictive. For example, in still further implementations, fold out shelves, hinged work spaces, or other functional components can couple to the nesting frame assembly. The scope of the invention is, therefore, indicated by the appended claims rather than by the foregoing description. All changes that come within the meaning and range of equivalency of the claims are to be embraced within their scope.

We claim:

1. A nested wall module for use in a modular wall system, the nested wall module having at least one center-mounted panel mounted to opposing face-mounted panels, so that the center-mounted panel and at least one of the face-mounted panels are exposed as viewable surfaces of the modular wall system at the same time, the nested wall module comprising:

a support frame having at least two upright supports that are each attached to one or more horizontal cross members;

a center-mounted panel secured within a channel of the one or more horizontal support members;

a pair of opposed face-mounted panels secured about the support frame and about the center-mounted panel, such that an exposed surface of at least one of the face-mounted panels is parallel to one of the exposed surfaces of the center-mounted panel, and such that the exposed surface of the at least one face-mounted panel extends further away from the support frame relative to the center-mounted panel; and a nesting frame assembly coupling the center-mounted panel and the pair of face-mounted panels together wherein one of:

the center-mounted panel is nested within the pair of face-mounted panels; or the pair of face-mounted panels are nested within the center-mounted panel.

2. The nested wall module as recited in claim 1, wherein the nesting frame assembly comprises:

one or more panel channels within which the center-mounted panel is secured; and a plurality of engagement protrusions to which the pair of face-mounted panels are secured.

3. The nested wall module as recited in claim 2, wherein:

the nesting frame assembly comprises a plurality of nesting brackets; and each bracket including a panel channel and a plurality of engagement protrusions.

4. The nested wall module as recited in claim 3, further comprising a plurality of adjustable cinch assemblies coupling the plurality of nesting brackets together.

5. The nested wall module as recited in claim 2, wherein:

the pair of face-mounted panels each comprise a hole within which the center-mounted panel is secured; and the center-mounted panel is nested within the pair of face-mounted panels.

6. The nested wall module as recited in claim 5, wherein:

the nested wall system comprises one or more additional center-mounted panels nested within the pair of face-mounted panels; and the pair of face-mounted panels conceals the support frame.

7. The nested wall module as recited in claim 6, further comprising a second pair of face-mounted panels nested within the center-mounted panel, wherein the second pair of face-mounted panels protrude outwardly from an exposed surface of the center-mounted panel.

8. The nested wall module as recited in claim 2, wherein the center-mounted panel comprises a hole within which the pair of face-mounted panels are secured.

9. The nested wall module as recited in claim 1, wherein the nested wall module comprises a functional component nested therein.

10. A modular wall system incorporating nested wall modules, which include one or more face-mounted panels or one or more center-mounted panels, the system comprising:

a plurality of wall modules coupled together to form a divider or wall providing a viewable surface;

wherein:

one or more wall modules of the plurality of wall modules comprise a nested wall module; and the nested wall module comprises:

a pair of face-mounted panels coupled to and concealing an outside surface of a support frame, and a center-mounted panel mounted within a channel formed in one of: (i) an inside surface of the support frame; and (ii) a bracket coupled to the pair of face-mounted panels; and a nesting frame assembly securing the center-mounted panel and the pair of face-mounted panels together;

wherein the center-mounted panel, and at least one of the pair of face-mounted panels are both viewable as part of the viewable surface of the divider or wall.

11. The modular wall system as recited in claim 10, wherein the support frame comprises:

a first upright support;

a second upright support;

an upper cross member extending between the first and second upright supports; and a lower cross member extending between the first and second upright supports.

12. The modular wall system as recited in claim 11, wherein:

the center-mounted panel extends:

between the first and second upright supports; and between the upper cross-member and the lower cross member; and the pair of face-mounted panels are nested entirely within an opening in the center-mounted panel.

13. The modular wall system as recited in claim 11, wherein:

the pair of face-mounted panels extends between the first and second upright supports;

a back surface of each panel of the pair of face-mounted panels is secured to the upper cross-member and the lower cross member; and the center-mounted panel is nested entirely within an opening in the pair of face-mounted panels.

14. The system as recited in claim 11, further comprising:

wherein the nesting frame assembly comprises one or more nesting brackets, each bracket including:

the channel within which the center-mounted panel is secured;

a plurality of engagement protrusions to which a back surface of each of the pair of face-mounted panels is secured.

15. The modular wall system as recited in claim 10, wherein the nested wall module comprises a functional component nested therein.

16. A nesting frame assembly, comprising:

a plurality of nesting brackets, wherein at least two nesting brackets of the plurality of nesting brackets comprise mitered ends that define an angle of the nesting frame assembly; and one or more corner cinch assemblies sized and configured to each couple two nesting brackets of the plurality of nesting brackets together;

wherein each bracket of the plurality of nesting brackets comprises:

a panel channel sized and configured to hold an edge of a center-mounted panel therein;

one or more cinch channels sized and configured to a corner cinch assemblies; and one or more engagement protrusions configured to couple one or more connectors;

wherein at least one bracket of the plurality is configured to support a center-mounted panel on one side of the at least one bracket, and to support at least one face-mounted panel on another side thereof, so that both the center-mounted panel and face-mounted panel are supported by the same at least one bracket and are viewable as outside surfaces of a modular wall at the same time.

17. The nesting frame assembly as recited in claim 16, wherein at least one corner cinch assembly of the one or more corner cinch assemblies further comprises:

one or more cinch plates;

a corner cinch plate; and a plurality of couplings configured to couple the one or more cinch plates to the corner cinch plate.

18. The nesting frame assembly as recited in claim 17, wherein:

the plurality of couplings are further configured to move the one or more cinch plates closer to the corner cinch plate; and the at least one corner cinch assembly is configured to move at least two nesting brackets of the plurality of nesting brackets closer together when the one or more cinch plates move closer to the corner cinch plate.

19. The nesting frame assembly as recited in claim 16, wherein:

each mitered end of the mitered ends has an angle less than 90 degrees.

20. The nesting frame assembly as recited in claim 19, wherein:

the mitered ends have angles of approximately 45 degrees; and the at least two nesting brackets of the plurality of nesting brackets are configured to form an approximately 90 degree angle therebetween when coupled by the one or more corner cinch assemblies.

21. The nesting frame assembly as recited in claim 16, wherein at least one cinch channel of the one or more cinch channels further comprises one or more lips sized and configured to retain at least one corner cinch assembly of the one or more corner cinch assemblies within the one or more cinch channels.

22. The nesting frame assembly as recited in claim 16, wherein the at least one bracket comprises a channel for holding and supporting the center-mounted panel.

23. The nesting frame assembly as recited in claim 22, wherein the at least one bracket comprises one or more engagement protrusions for receiving and holding one or more connectors of a face-mounted panel.

24. The nesting frame assembly as recited in claim 16, further comprising a functional component or functional feature mounted therein.

* * * * *

UNITED STATES PATENT AND TRADEMARK OFFICE

CERTIFICATE OF CORRECTION

PATENT NO. : 9,003,731 B2
APPLICATION NO. : 13/579257
DATED : April 14, 2015
INVENTOR(S) : Gosling et al.

It is certified that error appears in the above-identified patent and that said Letters Patent is hereby corrected as shown below:

IN THE SPECIFICATION

Column 1
Line 16, change "invention" to --This invention--

Column 8
Line 16, change "cross members cross members" to --cross members--

Column 9
Line 66-67, change "that that" to --that--

Column 12
Line 16, change "he nesting brackets" to --the nesting brackets--
Line 20, change "to or more" to --two or more--
Line 53, change "the each" to --each--

Column 13
Line 63-64, change "cinch couplings cinch couplings" to --cinch couplings--

Column 15
Line 48, change "shelf 401" to --shelf 400--

Column 16
Line 24, change "240i" to --240i.--

Signed and Sealed this
Twenty-third Day of February, 2016

Michelle K. Lee

Michelle K. Lee
*Director of the United States Patent and Trademark Office*